US008916106B2

(12) United States Patent
Gaj et al.

(10) Patent No.: US 8,916,106 B2
(45) Date of Patent: Dec. 23, 2014

(54) DETERGENT DELIVERY DEVICE

(75) Inventors: Renato Gaj, Alessandria (IT); Marco Moro, Alessandria (IT); Paolo Savini, Alessandria (IT)

(73) Assignee: Reckitt Benckiser N.V., Hoofddorp (NL)

( * ) Notice: Subject to any disclaimer, the term of this patent is extended or adjusted under 35 U.S.C. 154(b) by 474 days.

(21) Appl. No.: 13/390,997

(22) PCT Filed: Aug. 25, 2010

(86) PCT No.: PCT/GB2010/051403

§ 371 (c)(1),
(2), (4) Date: Apr. 11, 2012

(87) PCT Pub. No.: WO2011/023995

PCT Pub. Date: Mar. 3, 2011

(65) Prior Publication Data

US 2012/0189506 A1 Jul. 26, 2012

(30) Foreign Application Priority Data

Aug. 26, 2009 (GB) ..... 0914869.3

(51) Int. Cl.

| | |
|---|---|
| ***B01D 11/02*** | (2006.01) |
| ***B01D 12/00*** | (2006.01) |
| ***B01D 15/00*** | (2006.01) |
| ***A47L 15/44*** | (2006.01) |
| *A61L 2/00* | (2006.01) |
| *A61L 2/18* | (2006.01) |
| *A61L 9/00* | (2006.01) |
| *B65H 1/00* | (2006.01) |
| *B67D 7/78* | (2010.01) |

(52) U.S. Cl.

CPC ..... *A47L 15/4445* (2013.01); *A47L 15/4472* (2013.01)

USPC ..... 422/271; 422/28; 422/261; 422/263; 422/266; 422/269; 422/276; 134/56 R; 221/197; 221/198; 222/144

(58) Field of Classification Search

USPC ..... 422/28, 261, 263, 266, 269, 271; 134/56; 221/197, 198; 222/144

See application file for complete search history.

(56) References Cited

U.S. PATENT DOCUMENTS 3,125,249 A 3/1964 Kendt

FOREIGN PATENT DOCUMENTS

| | | | | |
|---|---|---|---|---|
| GB | 2231339 A | 11/1990 | | |
| WO | 2008053189 A1 | 5/2008 | | |
| WO | WO 2008053178 A1 * | 5/2008 | ..... | A47L 15/44 |
| WO | 2008145969 A1 | 12/2008 | | |

OTHER PUBLICATIONS

International Search Report for application PCT/GB2010/051403 dated Nov. 8, 2010.

* cited by examiner

*Primary Examiner* — Regina M Yoo

(74) *Attorney, Agent, or Firm* — Troutman Sanders LLP; Ryan A. Schneider

(57) ABSTRACT

The invention relates to a multi-dosing detergent delivery device. In embodiments of the present invention, the multi-dosing detergent delivery device comprises: a housing comprising a base and a lid; a refill holder and shaft located within the housing and arranged, in use, for receiving thereon a cartridge having a plurality X of chambers each accommodating a detergent composition; a directing means formed in the lid of said device to direct, in use, wash liquor collected on said lid selectively into a chamber of the cartridge to contact the detergent composition therein; an outlet formed in a base region of said housing to allow, in use, detergent loaded wash liquor to exit the device; and indexing means located within the shaft of the device for causing, in use, automatic movement of said cartridge relative to said housing during and subsequent to a wash cycle so as to cause a neighboring chamber to be in an exposed, ready to be used, position prior to a next washing cycle, said indexing means comprising: a thermally reactive element, a resilient biasing means, a gearing mechanism and a clutch element for selectively decoupling torque forces generated by expansion of said thermally reactive element from said shaft.

31 Claims, 14 Drawing Sheets

1

3
32
34
2

2
100

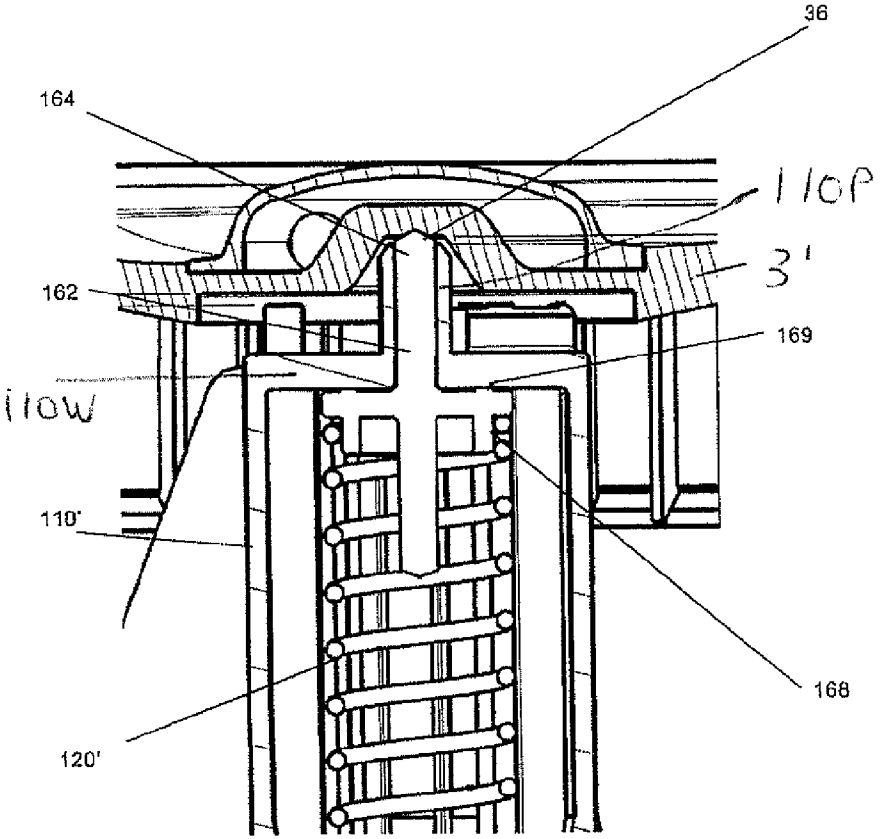
Fig. 8
Fig 7
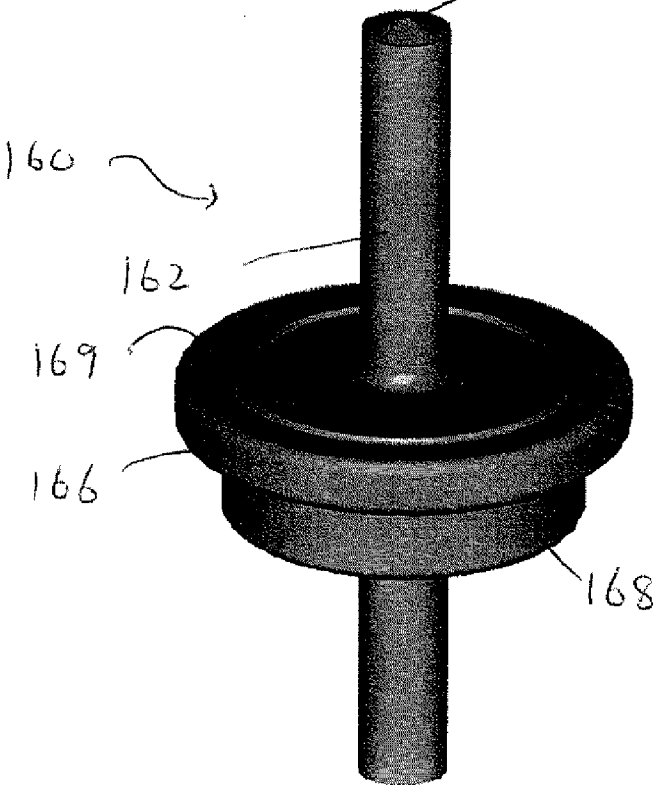

DETERGENT DELIVERY DEVICE

This is an application filed under 35 USC 371 of PCT/GB2010/051403.

The invention relates to improvements to a detergent delivery device. In particular, it concerns improvements to multi-dosing detergent delivery devices of the type used, for instance, within dishwashing machines where a detergent is dispensed automatically over a plurality of washing cycles without the requirement for a user to refill the device.

A number of devices are known for holding unit doses of a detergent composition or additive, such as detergent tablets, and for dispensing of such unit doses into a machine.

WO 01/07703 discloses a device for the metered release of a detergent composition or additive into a dishwashing machine having a number of separate sealed chambers for holding the detergent composition or additive and means for piercing the chambers, activated by conditions within the machine.

WO 03/073906 discloses a free standing device for dispensing multiple doses of detergent into a dishwasher. The device has a plate-like construction. A round blister pack having a plurality of doses arranged around its periphery is loaded into the pack. A winder is then rotated to load mechanical energy into the device sufficient to dispense more than one dose of detergent. A thermally operated latch then moves when the device is subjected to the elevated temperatures within the dishwasher and, in cooperation with a ratchet mechanism, moves the blister pack so that the next dose of detergent is ready for dispensing. In order to dispense the detergent, either the blister pack is pierced, or the dose is ejected from its compartment within the blister pack.

WO 03/073907 discloses a similarly shaped free standing dispensing device. In order to dispense detergent, a lever is manually operated to move a blister pack either to eject the detergent from a compartment within the blister pack, or to pierce the blister pack. A door or flap initially prevents wash liquor within the machine from accessing the exposed detergent. A bi-metallic strip is provided to move the door or flap when the device is exposed to the elevated temperatures during a washing cycle to allow access of the wash liquor to the exposed detergent thereby dispensing the detergent to the machine.

One particular device of great utility, which is the subject of WO 2008/053189 comprises a multi-dosing detergent delivery device, the device comprising a housing for receiving therein a cartridge having a plurality X of chambers each accommodating a detergent composition, a directing means to direct, in use, wash liquor selectively into a chamber of the cartridge to contact the detergent composition therein and an outlet to allow the detergent loaded wash liquor to exit the device, wherein the device further comprises indexing means for automatic movement of said cartridge, in use, relative to said directing means during and subsequent to a wash cycle so as to cause a neighbouring chamber to be in an exposed, ready to be used, position prior to a next washing cycle.

The above-mentioned device has a particularly refined automatic indexing mechanism for automatically advancing between doses of detergent and is particularly advantageous in that it can cope with the fact that a dishwasher machine may during a single cycle include intermediate cycles where temperatures may rise in an initial part of a cycle, then drop and subsequently rise again. In such situations other devices may "double dose" the detergent, whereas the device of WO 2008/053189 avoids this by the use of a thermally reactive element such as a wax motor which expands a wax canister during a heating phase of a washing cycle and contracts as it cools during and subsequent to a final cooling phase of said washing cycle. Here, the relatively slow reaction of the wax canister and the fact that a majority of movement of the indexing mechanism happens during a cooling cycle manages the situation of avoiding double dosing To understand the operation of this prior art device in more detail, that device will now be described with reference to the accompanying drawings, in which:

FIGS. 1(*a*), 1(*b*) and 1(*c*) are perspective assembled, perspective exploded and internal perspective views of a housing part and lid of such a device;

FIGS. 2(*a*) and (*b*) are schematic perspective views from above and from below showing a refill holder for use with the device;

FIGS. 3(*a*) and 3(*b*) show a refill cartridge for use with the refill holder of FIGS. 2(*a*) and (*b*), whilst FIG. 3(*c*) shows a single chamber of a refill cartridge.

FIGS. 4(*a*) and 4(*b*) are perspective exploded and perspective partial assembly views of an automatic indexing mechanism of the device;

FIG. 5 shows in perspective cross-sectional view the automatic indexing mechanism of FIG. 4; and FIGS. 6(*a*) to 6(*d*) show the various states of the indexing mechanism of FIGS. 4 and 5 as temperature within an appliance utilising the device changes during a dishwashing cycle;

FIGS. 1(*a*), 1(*b*) and 1(*c*) show respectively perspective assembled, perspective exploded and internal perspective views of detergent dispensing device 1 comprising a housing 2 and a lid 3. The housing 2 has an indexing mechanism 100 housed within it and described later. The lid 3 has a window 32 to allow a user to see by means of a visual indicator a number of washes used or remaining for use with the device and also has directing means comprising an aperture 34 for directing wash liquor/water to the interior of the housing. The lid 3 has a general funnel like appearance to facilitate the collection of wash liquor/water available to the directing means.

The housing 2 is arranged to receive a refill holder 4 as shown in FIG. 2(*a*) which shows a refill holder in front perspective view and FIG. 2 (*b*) which shows the holder in bottom perspective view. The refill holder 4 comprises a plurality of dividing fingers 5 emanating from a central hub 6 and has a base 7 featuring a number of apertures 8 and lower location slots 9. Internally of the hub 6, there are formed one or more upper locating tabs 10 (four shown in the figure), whilst externally and at a central portion thereof there is provided numbering from 1 to 12 representing the number of washing cycles that an associated refill may have undergone or have remaining. The window 32 of the lid has a transparent portion that is, in use, aligned with the relevant sector of the numbered area.

The refill holder 4 is, in use, positionable within the housing 2 and the hub 6 has a hollow formation to co-operate with, and fit over, a central shaft 110 of the indexing mechanism 100 as will be described later.

The fingers 5 are arranged to co-operate with and register with internal spaces formed between parts of a disposable refill package 200 such as the one shown in FIGS. 3(*a*) and 3(*b*) and having individual chambers 210 as shown in FIG. 3(*c*). The refill package 200 is a cartridge that comprises a plurality of like chambers 210, and has a roll formation. The chambers 210 are separate from each other and comprise plastic sleeve or blister packages. The chambers 210 are spaced apart, having gaps between them that are apt to be engaged by the fingers 5 of the refill holder 4. Each chamber has an upper opening 220 and a lower opening 240 that is, in use, in register with one of the apertures 8 of the refill holder.

Each chamber 210 is filled with sufficient cleaning composition for the completion of one dishwasher cycle. The contents of the chambers 210 are preferably in solid form and, therefore there is no problem with inadvertent spillage. There is also a central gap 250 in a central hub area that facilitates the placement of the refill 200 onto the refill holder 4.

Referring now to FIGS. 4(*a*) and 4(*b*) there is shown an indexing mechanism for automatically rotating the refill holder 100 and refill 200 of the device 1 relative to the housing 2 and lid 3.

The indexing mechanism 100 comprises a shaft 110, a spring 120, a cursor element 130, a cam 140 and a thermally reactive element that is preferably a wax motor 150.

The shaft 110 is hollow and receives the other components of spring, 120, cursor 130, cam 140 and wax motor 150 therein.

The shaft 110 has a closed end region 114 for providing a seat to the spring 120 and, approximately mid-way down a length of the shaft 110 there are formed internally a plurality of spaced apart downwardly depending straight parallel grooves 112, each of these grooves has a sloping lowermost portion as will be described presently.

The cursor 130 is locatable within the shaft 110 and, at its upper most portion provides a lower seating for the spring 120. It also has moulded thereon an upper and lower set of gear teeth 132, 134.

Cam element 140 is arranged for selective co-operation with the cursor element 130 and it too has an upper set of gear teeth 142 and has locating tangs 144 to locate it positively in use against refill holder 4. The cam element 140 has a central aperture to allow the wax motor element to sit within it.

Wax motor 150 comprises a wax can and a piston. Essentially, as wax is heated it expands and pushes against the piston, as it cools down, the wax contracts and, aided by spring action of the spring 120, the piston returns to its original position. In the device of the preferred embodiment, the wax motor sits at the bottom of the shaft 110 in the space provided by the central aperture of the cam element and the piston acts so as to cause the cursor 130 to rise and fall as appropriate during a heating/cooling cycle.

The inter-relation between all of the parts mentioned up to now will next be discussed.

Firstly, it will be appreciated that the housing 2, indexing mechanism 100 and the refill holder 4 are readily assembled into a single unit. Referring to FIG. 5, there is shown in a partial cut-away form a part of the shaft 110, the spring 120, cursor 130 and cam 140 all seated within the shaft 110. Here, the spring 120 seats against the internally closed top end of the shaft 120 and against the top of the cursor 130, whilst the wax motor 140 is positioned within the central aperture of the cam 140 and, at its lower end bears against a part of the base of the housing 2 and at its upper end against the cursor 130. The refill holder 4 is placed over the shaft 110 of the indexing mechanism and is located thereon by co-operation of its locating tabs 10 with corresponding formations in the form of locating slots 116. The refill holder also locates to the cam element 140 by co-operation between slots 9 and tangs 144, so that the shaft 110 and the cam 140 are locked to the refill holder 4.

Although not shown in the figures, the cursor element 130 is constrained such that it cannot rotate with respect to the holder 2, but it can be displaced in the vertical plane as such, it constitutes a linear element. The refill holder 4 on the other hand, is (once a refill 200 has been associated with it and the device 1 has been closed by associating the lid 3 with the housing 2) constrained such that it cannot be significantly displaced in a vertical direction, but is capable of rotation within the housing 2 and as such constitutes a first rotational element.

There will now be described, with reference to the figures the use of the device and a cycle which takes place upon heating of an assembled device/refill combination.

When the user first receives the device, the user will note that the lid of the device 3 includes a window 32, through which one of the numerals on the number dial 6 is visible. For a new device, the preferred number that the user will see is number "1". This indicates to the user that the device is a new device, and is ready for its first cycle within the dishwashing machine.

Generally, the device will include a clip or mounting device (not shown), which will permit the user to attach the device to the upper wire basket of a dishwasher, preferably in a discrete location such as a corner. The user then need only close the door of the dishwasher and select an appropriate programme.

The device as shown in the figures hosts twelve separated doses of detergent, within twelve individual chambers.

In the start position for the very first wash, an aperture 34 in the lid 3 is generally aligned with opening 220 of the refill 200. It should be noted here that lower opening 240 (which in general is of an identical size to upper opening 220) is an outlet hole, whilst upper opening 220 is an inlet hole, so that water dispensed by a dishwasher during a washing cycle and collected by the lid 3, may wash through the exposed compartment 210, and enter into the dishwasher carrying dissolved or particulate cleaning composition from the chamber 210. The lower opening 240 need not be precisely aligned with a particular outlet hole formed in the housing 2, but instead the housing 2 may simply have one or more drainage holes which, under gravity, will allow the water and cleaning composition to exit from the device 1.

Indexing of the refill holder 4, and its associated refill package 200 so that a next chamber 210 is ready during a second washing cycle is accomplished by means of the indexing mechanism 100.

The general principles promoting the indexing of the refill 200 and holder 4, are that the indexing mechanism 100 includes a wax motor element 150. This wax motor element 150, basically consists of a wax can and piston. In preferred embodiments, the wax motor delivers up to 300 N of force. When the water in the dishwasher gets warm, the wax in the can starts to expand and pushes the piston out of the wax can. When the dishwasher cools down, strong spring 120 pushes the piston back into the wax can.

Up and down movement of the piston of the wax motor 150 is translated into a rotation of the refill cartridge 200 and its holder 4, by means of a gearing system comprising the cam, cursor, and shaft of FIGS. 4(*a*) and (*b*).

FIG. 5 shows schematically a start position of the gearing system, in which the linear element, the cursor 130, is meshed with a first rotational element in the form of cam element 140, but separated from contacting with the interior of the shaft 110 (which forms a second rotational element). In other words, the upper set of gear teeth 132 of the cursor 130 are completely separated from the parallel grooves 112 forming gear teeth of the shaft 110, but the lower set of gear teeth 134 of the cursor 130, are meshed with the gear teeth 142 of the cam 140.

Here, it should be noted that each of the portions acting as gears, include sloping teeth, for promoting gear meshing in a particular rotational direction, and gap portions for ensuring positive engagement in particular positions.

In the state shown in FIG. 5, there is no heat applied to the wax motor 150. However, within the dishwasher cycle, the conditions applied involve rising temperature sections, during a given washing programme, followed by cooling conditions. The functioning of the wax motor mechanism 150, and the various cam 140, cursor 130, and shaft 110 motions will now be described in particular with reference to FIG. 6(*a*) through FIG. 6(*d*).

FIG. 6(*a*) shows what happens during a first part of a heating cycle. During this heating cycle, the piston of the wax motor 150 extends so as to raise the cursor element 130, and disengage the lower gear teeth 134 of the cursor 130, from the gear teeth 142 of the cam 140. Indeed, as the cursor element 130 rises, the lowermost extent of the cursor 130 becomes completely clear of the cam element 140. At some point, during the heating cycle, sloping surfaces of the upper set of gear teeth 132 of the cursor 130, come into contact with sloping surfaces at the end of gear teeth provided by the formations 112 internally of the shaft 110. It is to be noted here that the sloping surfaces co-operate in such a manner that, as the cursor 130 may only move in the vertical plane, but the shaft 110 cannot move in the vertical plane, but instead is allowed to move rotationally in the horizontal plane, the shaft 110 is forced to rotate in the direction dictated by the sloping surfaces. In this way, as temperature rises still further, the point shown in FIG. 6(*b*) is reached, where a partial rotation of the shaft 110, and thereby of the associated refill holder 4, and refill 200 has occurred and, further heating simply results in the cursor 130 rising still further, and its upper gear teeth 132, which are elongated, rise vertically into gaps formed between the gear teeth 112. Therefore, during a heating cycle, a controlled amount of rotation occurs, dictated by the formation of the gearing of the upper teeth 132, and the formations 112 (which for reasons which we shall explain later gives a 6° rotation during a heating cycle) is facilitated and, thereafter, further heating does not cause further rotation, but instead causes greater meshing between the gear teeth 132, and the gaps between formations 112 on the shaft.

Thereafter, during a prolonged cooling cycle, the procedures shown in FIGS. 6(*c*) and 6(*d*) occur. Firstly, during the cooling, the cursor 132 descends vertically, as the piston of the wax motor 150, retracts under action of the spring 120. Eventually, the cursor pulls clear of the formations 112 of the shaft 110. Then, during a final phase of the cooling cycle, the lower set of teeth 134 of the cursor 130, come into contact with the gear teeth 142 of the cam 140. Here, it will be noted that both the cam 140 and the shaft 110 are linked to motion of the refill holder 4, and refill 200, and therefore the cam 140 also underwent the 6° rotation undergone during the heating cycle. Consequently, when the lower set of gear teeth 134 descend to meet the gear teeth 142 of the cam 140, they are not aligned, as they previously were. As the sloping surfaces formed on the top of the gear teeth 142, and on the base of the lower set of gear teeth 134, come into contact with each other a rotational movement of the shaft 110, refill holder 4 and refill 200 is caused. Here, the gearing of the sloping surfaces of the meshing teeth, are arranged so as to bring about a 24° rotation (again for reasons which will be described later). So that in the eventual position shown in FIG. 6(*d*) the lower set of gear teeth 134, are fully meshed with the gear teeth 142 of the cam 140. Again, it is of course noted that the cursor 130 is constrained to movement within the vertical plane, whilst the cam 140 and shaft 110, which are interlinked by the refill holder 4, are constrained to movement rotationally, within the horizontal plane.

From the above description, it can be seen that during any given washing cycle, heating up of the wax canister forming the wax motor 150, causes extension of a piston of the wax motor 150, and brings about vertical motion of the cursor 130. This vertical motion is translated into horizontal rotational movement of the shaft by a first amount during the heating cycle, and then by a second amount, at the end of a cooling cycle.

While the above device is extremely advantageous in providing automatic indexation and dosing of a detergent refill array, it has been found that the arrangement of shaft 110 with the spring 120 bearing directly against the closed end region 114 forming the inner top face of the shaft 110 can cause problems. In particular, the pressure exerted by the spring directly upon the shaft 110 causes the spring 120 to "wind up" and act against the desired rotation of the shaft 110 relative to the cursor 130. In extreme cases this can prevent correct operation and cause the shaft 110 simply to oscillate back and forth instead of indexing.

It is an aim of preferred embodiments of the invention to overcome or substantially alleviate the aforementioned problem of spring wind-up.

According to a first aspect of the invention, there is provided a multi-dosing detergent delivery device, comprising: a housing comprising a base and a lid; a refill holder and shaft located within the housing and arranged, in use, for receiving thereon a cartridge having a plurality X of chambers each accommodating a detergent composition; a directing means formed in the lid of said device to direct, in use, wash liquor collected on said lid selectively into a chamber of the cartridge to contact the detergent composition therein; an outlet formed in a base region of said housing to allow, in use, detergent loaded wash liquor to exit the device; and indexing means located within the shaft of the device for causing, in use, automatic movement of said cartridge relative to said housing during and subsequent to a wash cycle so as to cause a neighbouring chamber to be in an exposed, ready to be used, position prior to a next washing cycle, said indexing means comprising: a thermally reactive element, a resilient biasing means, a gearing mechanism and a clutch element for selectively decoupling forces generated by expansion of said thermally reactive element from said shaft.

Preferred features of the device of the first aspect are set out in accompanying claims 2 through 18.

According to a second aspect of the invention, there is provided a clutch element for a multi-dosing detergent delivery device, the clutch element comprising: a plate area and a central projection, wherein one side of said plate area is formed for seating against resilient biasing means of said device and the other side of said plate area is arranged for selective engagement against an inner upper end of a shaft of the device.

Preferred features of the second aspect are set out in accompanying claims numbered 20 to 24.

According to a third aspect of the invention, there is provided a method of indexing a multi-dosing detergent delivery device, wherein the device comprises:

a housing comprising a base and a lid; a refill holder and shaft located within the housing and arranged, in use, for receiving thereon a cartridge having a plurality X of chambers each accommodating a detergent composition; a directing means formed in the lid of said device to direct, in use, wash liquor collected on said lid selectively into a chamber of the cartridge to contact the detergent composition therein; an outlet to allow the detergent loaded wash liquor to exit the device; and indexing means for automatic movement of said cartridge relative to said housing during and subsequent to a wash cycle so as to cause a neighbouring chamber to be in an exposed, ready to be used, position prior to a next washing cycle, said indexing means being located within the shaft of the device and comprising: a thermally reactive element, a resilient biasing means, a gearing mechanism and a clutch element, wherein said method of indexing comprises: (A) expansion of said thermally reactive during a heating phase of a washing cycle; and (B) contraction of said thermally reactive element under pressure of said resilient biasing means as it cools during and subsequent to a cooling phase of said washing cycle, said gearing mechanism being arranged, in use, to convert linear expansion and contraction of said thermally reactive element to rotational movement of said refill holder and shaft relative to said housing and wherein said clutch element is provided between said resilient biasing means and said shaft so as to decouple said resilient biasing means from said shaft during at least part of said heating cycle.

Preferred features of the method of the third aspect are set out in accompanying claims 19-31.

In all aspects, preferably the clutch element is substantially decoupled from the movement of the shaft to minimise or eliminate torsional forces which would oppose rotary movement during a heating phase in a washing cycle, and is coupled to the movement of the shaft to utilise such forces during a cooling phase, subsequent to in washing cycle.

Preferably the present invention achieves its effects without any need for human intervention.

A preferred embodiment of the present invention will now be described with reference to the accompanying drawings, in which:

FIG. 7 shows a perspective view of a clutch element;

FIG. 8 is a schematic cross sectional side view showing detail of an assembled detergent dispensing device, and showing placement of the clutch element within such a device;

Figures 1A, 1B, 1C:
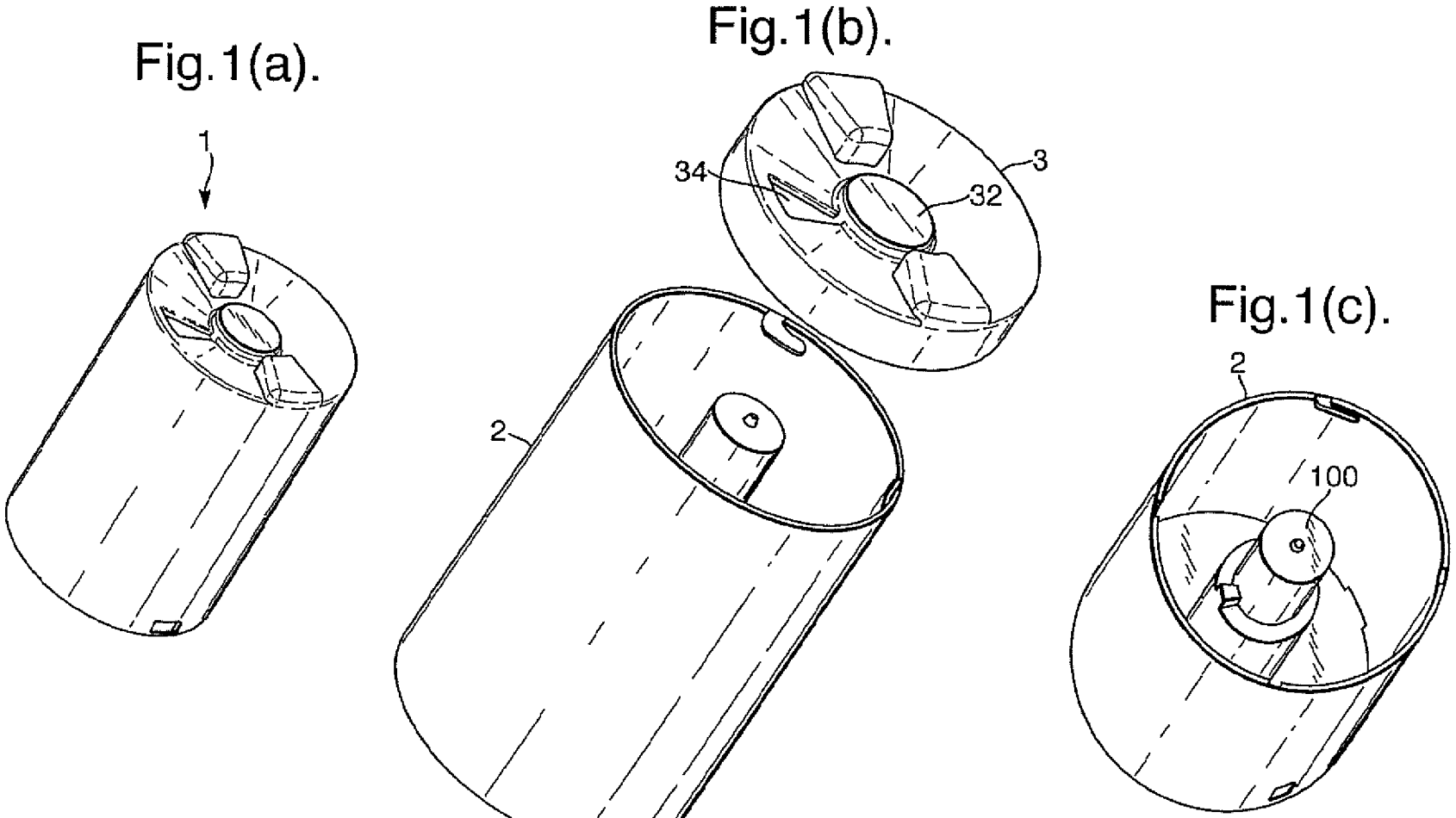
Figure 2B:
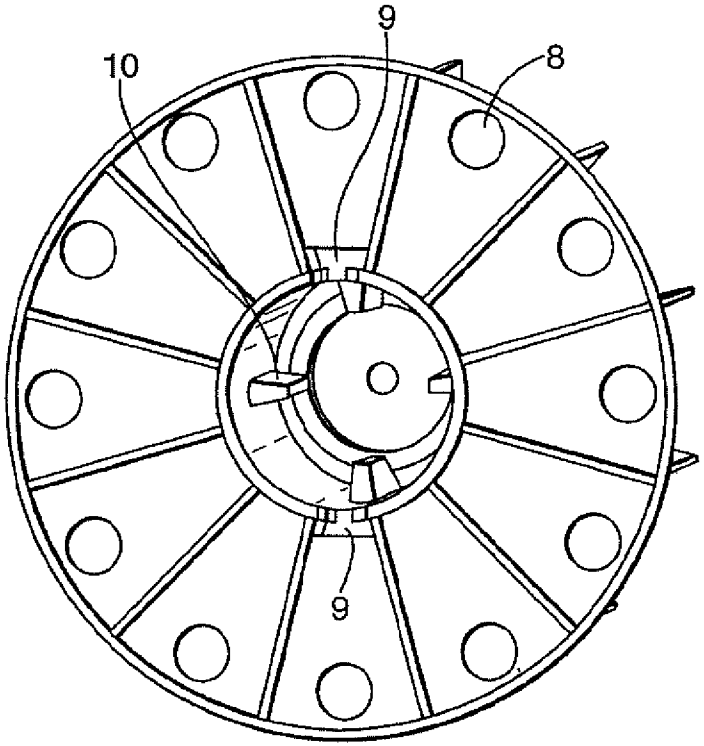
Figure 2A:
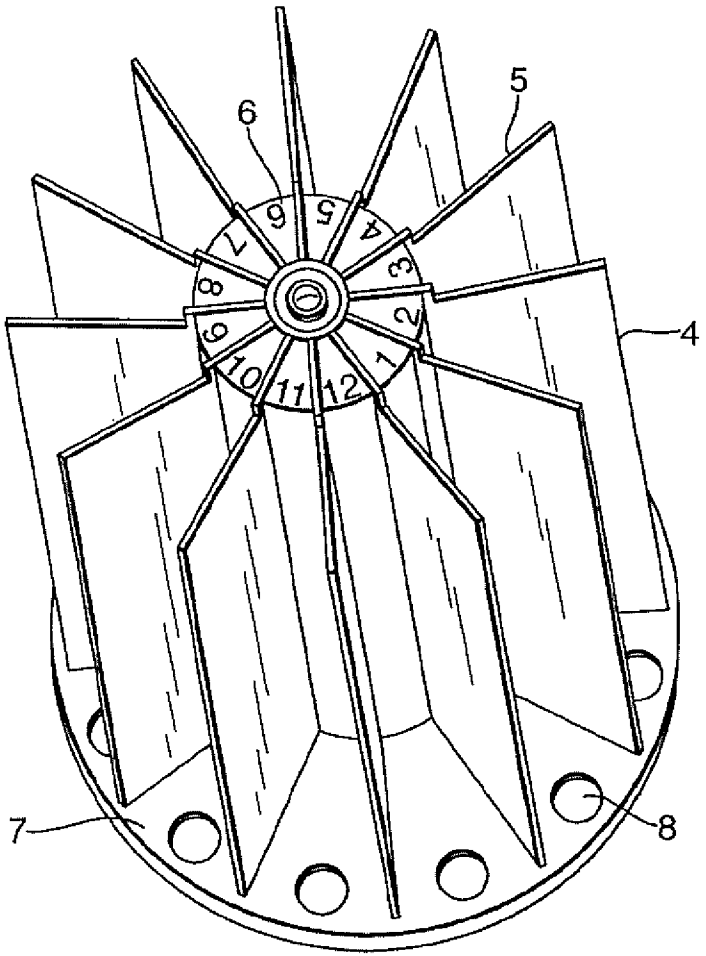
Figure 3A:
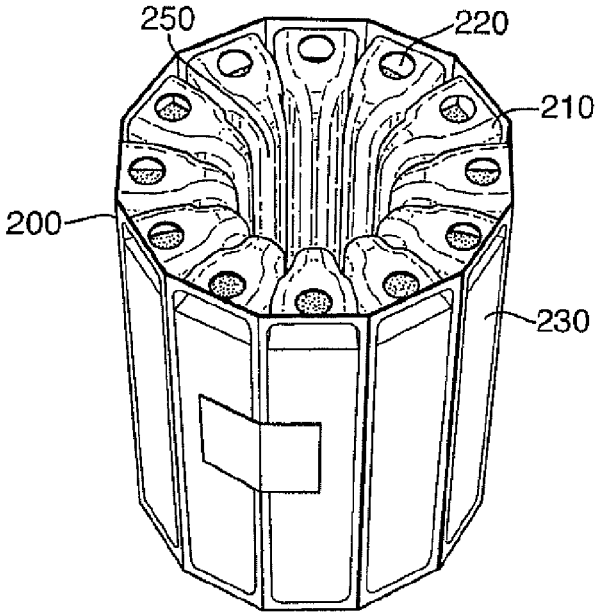
Figure 3B:
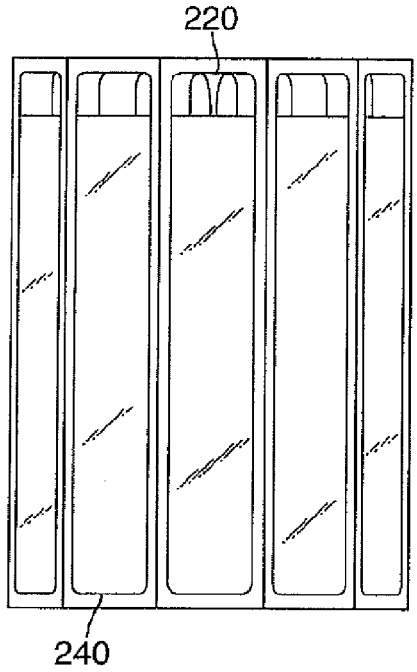
Figure 3C:
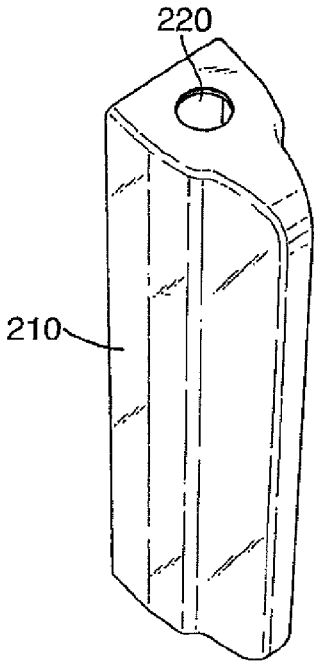
Figure 4B:
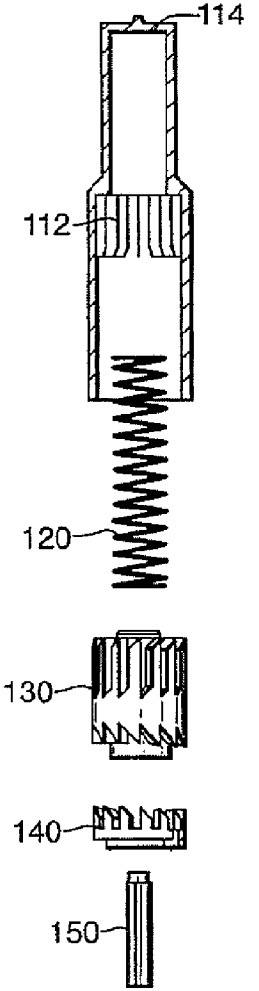
Figure 4A:
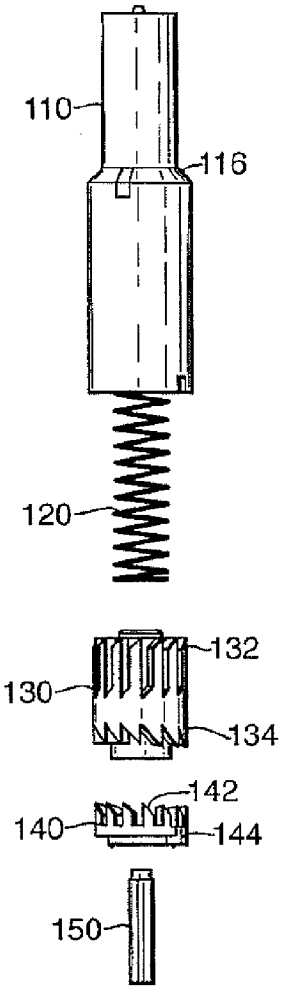
Figure 5:
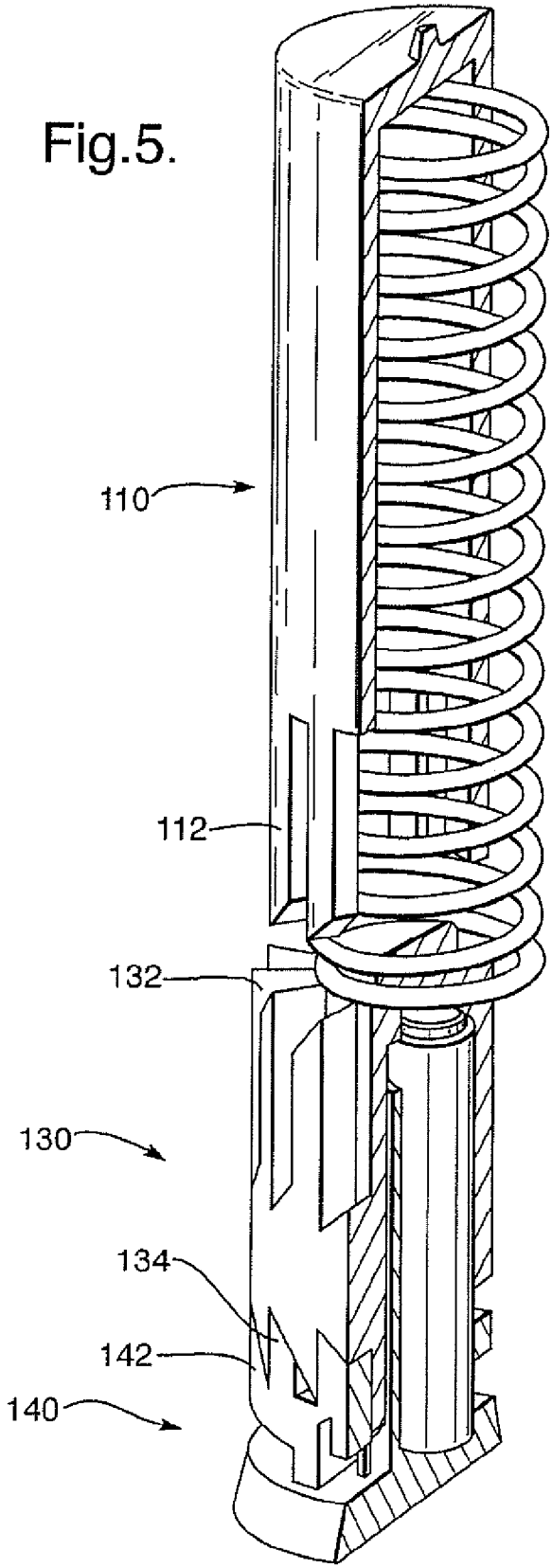
Figure 6B:
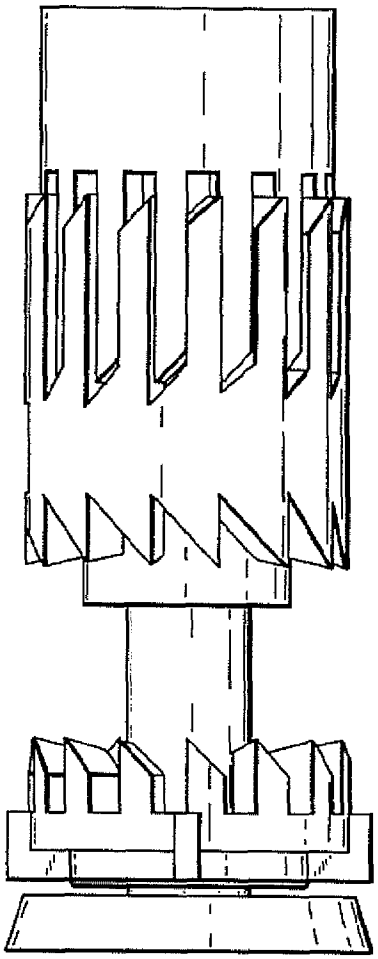
Figure 6A:
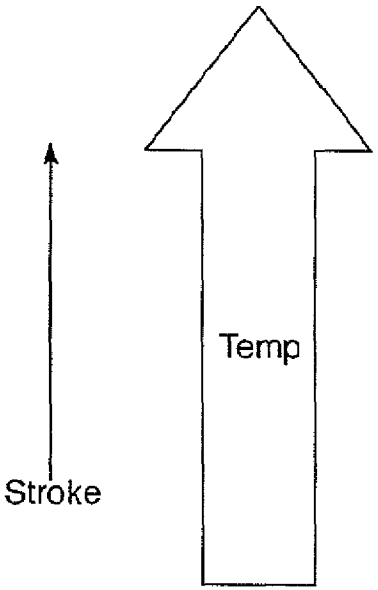
Figure 6A:
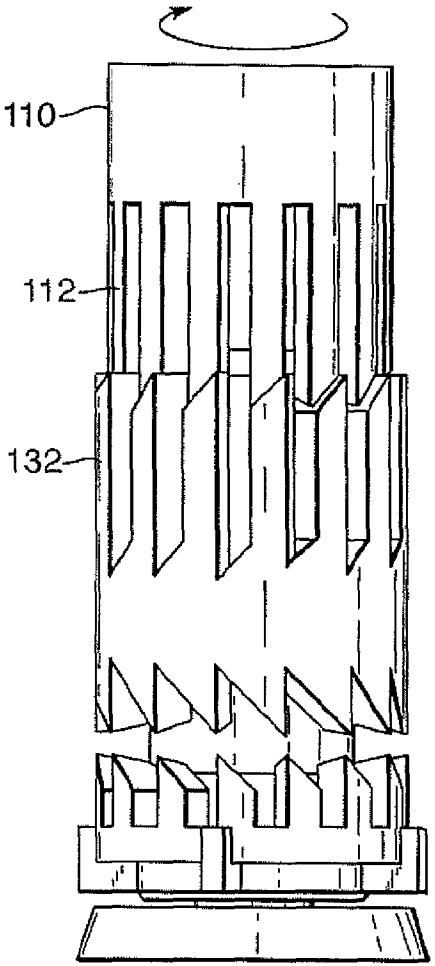
Figure 6D:
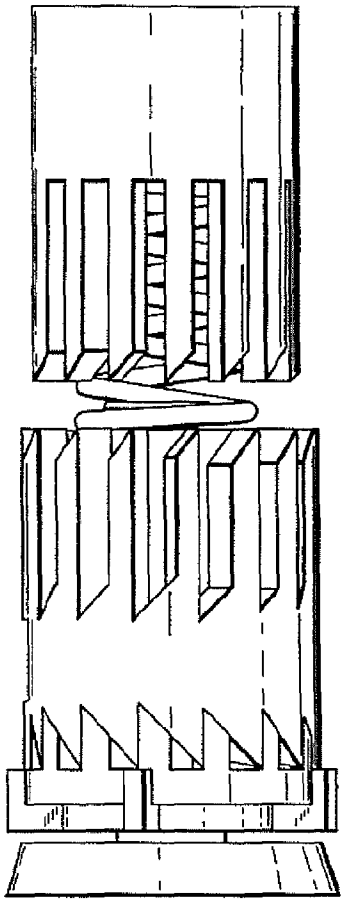
Figure 6C:
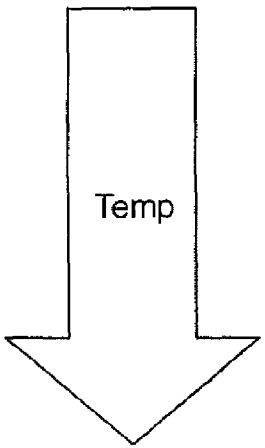
Figure 6C:
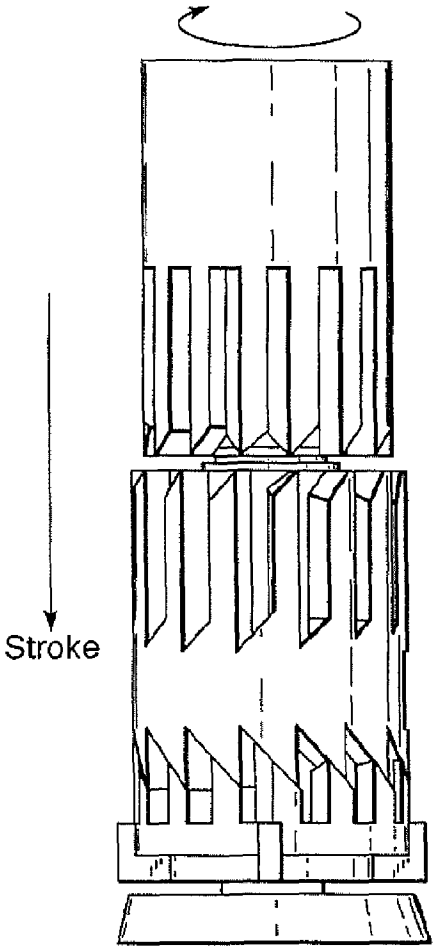

A preferred embodiment of the invention will now be described with reference to FIGS. 7 to 14(B). In these figures, the same reference numerals will be used (where appropriate) as were utilised in relation to the prior art of FIGS. 1 to 6 to designate the same or similar functional components, except that hereinafter each of these references will be distinguished with a prime (') suffix.

FIG. 7 shows a clutch element 160 for use in detergent dispensing devices in accordance with an embodiment of the invention.

Clutch element 160 comprises a central projection 162 with a somewhat pointed, or domed, tip 164, a spring seat area 166 with a downwardly depending skirt 168 and an upwardly facing circular ridge 169.

Referring now to FIG. 8, there is shown the general placement of the clutch element 160 within a detergent dispensing device. Here, tip 164 of clutch element 160 is seen as protruding through an upwardly extending hollow sleeve 110P portion, which itself projects from the outer face of the top wall 110W of the shaft 110'. The tip 164 is located in a well area 36 formed on an underside of device lid 3'. The tip 164 acts as a pivot point for the clutch element 160 and the interface between this tip and the well 36 in which it locates is arranged to provide minimal rotational friction resistance. The ridge 169 is here shown as bearing against the inner surface of the top wall 110W of the shaft 110', and the spring 120' seats against the underside of the clutch element 160 with its position there being defined by the skirt 168 which is located concentrically within the helix of spring 120'—in other words, the skirt 168 ensures that the central longitudinal axis of the spring lies along the central axis of the device.

In the discussion which follows, the same 6°/24° motion as described in relation to the prior art is to be assumed, with 6° of advance movement being applied during a heating cycle to fully expose a chamber of a refill device and 24° of further advance movement being applied during a cooling cycle.

Figure 9A:
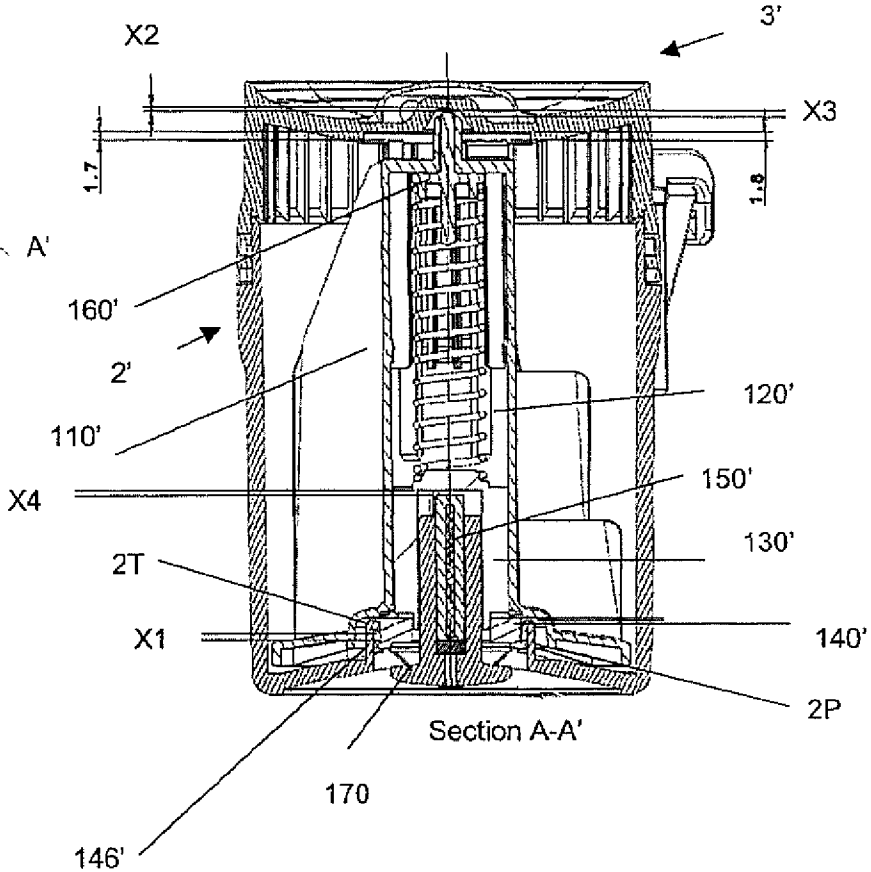
FIG. 9(A), is a cross-sectional side view of the assembled detergent dispensing device in a factory supplied "zeroed" condition.
Figure 9B:
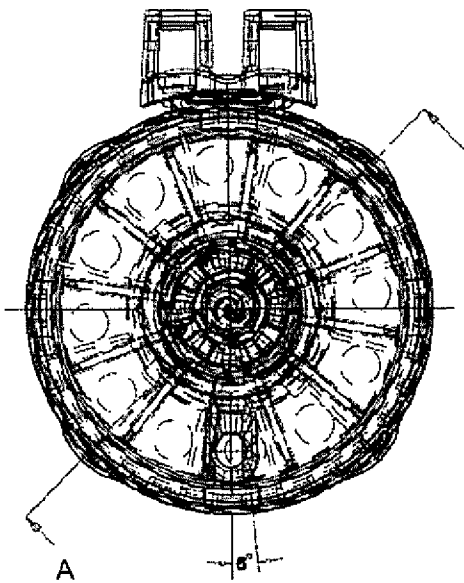
FIG. 9(B) shows the device of FIG. 10(A) from a top view.

Referring now to FIG. 9(A), there is shown a full cross-sectional schematic view of the detergent dispensing device, the cross-section being along line A-A' as shown in FIG. 9(B).

Here, the device is shown in a factory supplied condition, ready to be used within an automatic dishwasher, with the piston of wax motor 150' being fully retracted (pressed) into its cylinder. FIG. 9(B) illustrates that the device is in a condition prior to the initial 6 degree of advance applied during heating.

It should be noted that the device condition of FIG. 9(A) shows the spring 120' seated at its lower end upon a top surface of cursor element 130', and with the (fully retracted) wax motor 150' located beneath the cursor 130' and with its central axis aligned with the central axis of the device. The cursor element 130' sits on top of toothed cam 140'. The wax motor 150' sits within a holder 170, which in this embodiment is integral with the base region of the housing 2'.

The device features a one-piece combined shaft/refill holder 110'. Cam 140' is associated with the shaft 110' so that movements imparted to the cam 140' are directly translated to movements of shaft 110' and vice versa. Unlike the prior device however, the entire shaft 110'/cam 140' assembly is not constrained to rotational movement only. Instead, the cam 140' has upwardly facing lower tangs 146', that extend circumferentially around it and which are arranged to allow a degree of play in terms of vertical movement of the shaft 110' up to a limit defined by downwardly facing tangs 2T that are formed on protrusions 2P that extend upwardly from the device base. This "vertical play" allowance, or clearance, is shown by letter designation "X1" and is around 1.1 mm in FIG. 9(A).

In the condition shown in FIG. 9(A), the wax motor 150' is in a fully retracted state (in fact, in the factory supplied condition), in which no forces are being transmitted to the housing 2' or lid 3' of the device. In this condition there is a small degree of clearance "X2" (of around 0.8 mm in this embodiment) between the tip 164 and the associated contact position in the well area 36. The clutch element 160 is in contact with the inner face of the top wall 110W of the shaft 110', under the bias of the spring 120'; the spring is pre-compressed, and under compression at all times during operation of the device.

In the condition shown in FIG. 9(A), there is also a larger clearance "X3" (around 1.4 mm in this embodiment) between the tip of the upwardly extending hollow sleeve 110P and the lid 3', and a clearance "X4" (around 1 mm in this embodiment) between the piston of the wax motor 150' and the inner face of cursor element 130'.

The view in FIG. 9(B) illustrates that the device is in a −6° position, i.e. is set so that 6 degrees of rotational motion of the combined shaft/refill holder 110' is needed for the maximal exposure of the initial refill chamber of the device (which may not necessarily mean that the refill chamber is fully open to the inflow of water).

Figure 10A:
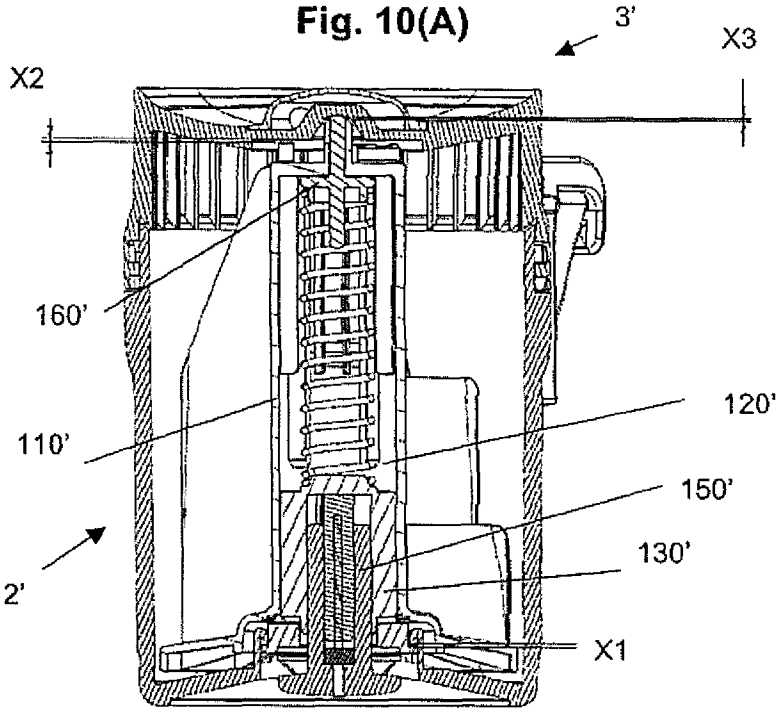
FIG. 10(A), is a cross-sectional side view of the assembled detergent dispensing device in a state in which the wax motor of the device is at the beginning of an expansion stroke.

Moving on to FIG. 10(A)/10(B), there is shown a situation early on during the heating cycle of the device in a dishwasher at the very beginning of the stroke of the wax motor 150'. At this point in the cycle, the piston of the wax motor has moved so as to come into contact with the closed upper wall of the cursor element 130' (X4=0 mm) and lift the entire shaft 110' assembly by forces exerted from the wax motor 150' being transmitted via the pre-compressed spring 120' to the clutch element 160 and thereafter to the combined shaft/refill holder 110'. The tip 164 of clutch element 160 now fits into well area 36 (clearance X2 is now zero), but is as yet not transmitting any significant force between the base of the housing 2' and the device lid 3'. Here, of course, previous clearance X4 between wax motor piston and cursor has closed to zero as the wax motor is beginning its stroke. In this state, clearance X1 is reduced to 1 mm, clearance X3 is reduced to 0.6 mm and the clutch element 160 is still in contact with the inner face of the top wall 110W of the combined shaft/refill holder 110'.

Figure 10B:
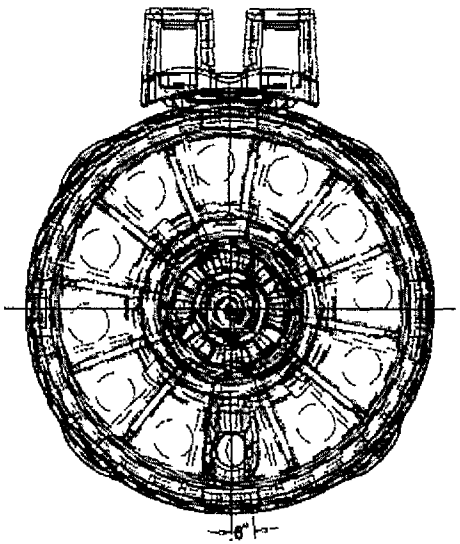
FIG. 10(B) shows the device of FIG. 11(A) from a top view.

In this situation, it should be noted that the forces which are imparted by the wax motor 150' are not yet being transmitted to the cursor 130'. As shown in FIG. 10(B), rotation of the shaft/refill holder 110' has not yet begun and the device is still at the −6° position.

Figure 11A:
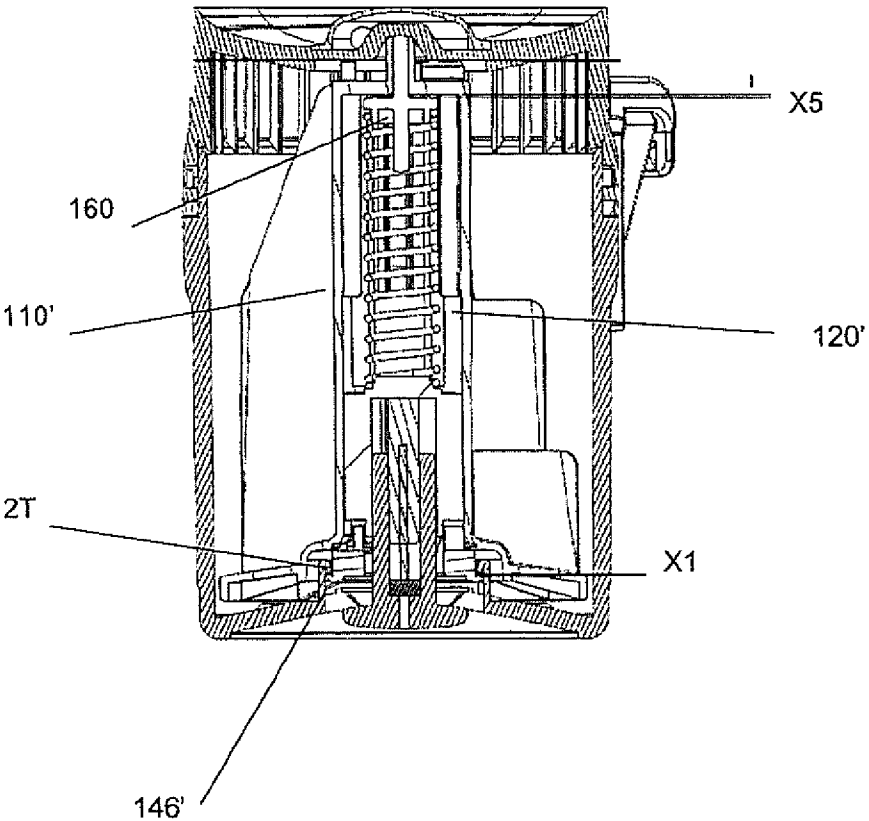
FIG. 11(A), is a cross-sectional side view of the assembled detergent dispensing device in a state in which the shaft of the device is about to start rotation during a heating cycle.
Figure 11B:
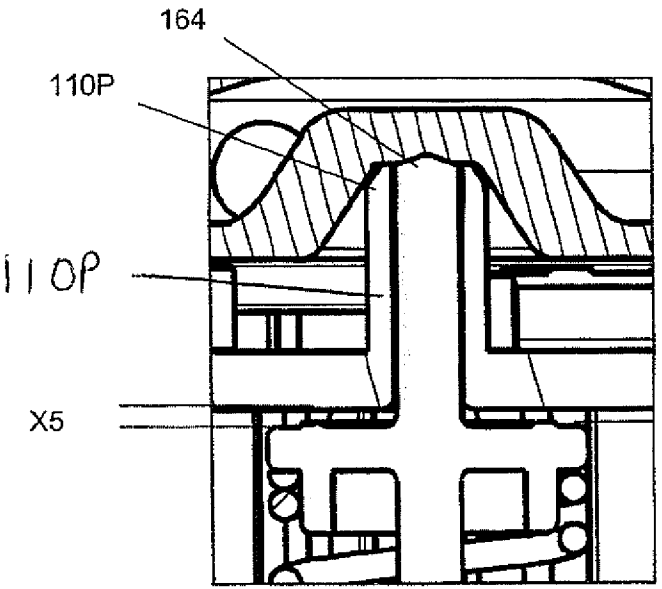
FIG. 11(B) is a detailed view of the clutch element of the device with the device in the FIG. 11(A) state.

Referring now to FIGS. 11(A), (B), a point is reached in the heating cycle where the shaft/refill holder assembly 110' rises. This small amount of vertical movement is possible, by virtue of both the clearance X1, between tangs 2T and 146', and the clearance X3, between the upwardly extending sleeve portion 110P formed at the uppermost end of shaft 110' and the lid 3'. At the same time the tip 164 which projects beyond the distal end of the sleeve 110P is moved into the sleeve 110P against the permanently acting bias of the spring 120', and the ridge 169 is urged out of contact with the inner surface of the shaft assembly 110', to give a clearance "X5" of about 0.6 mm in this embodiment. As a result there is no frictional force between the clutch element 160 and the shaft 110'.

At this stage, clearance X1 is still around 0.4 mm and there is therefore only minimal frictional hold upon the shaft 110" arising from the contact between sleeve 110P and lid 3'. Here, it should be noted that all the major forces of the expanding wax motor piston are transmitted directly between the lid 3' and the base of the device housing and, as the teeth and slots of the indexing mechanism engage further, the shaft 110' is able to rotate in the direction dictated by the sloping surfaces without needing to overcome any high frictional forces.

Because the shaft 110' is free to rise and lift free of the clutch element 160, forces imparted by the wax motor 150' via the cursor 130' and spring 120', are simply transmitted from base to lid of the device. Therefore, back-bouncing torsional forces of the compressed spiral spring 120', which would in the prior art device oppose device operation are simply uncoupled from the rotating parts. Thus, the combined shaft/refill holder 110' is freed from the influence of counter productive torsional forces in the spring 120' which might otherwise prevent or counter meaningful shaft rotation.

From now on in the operating cycle any further expansion of the was motor during the heating cycle are transformed in a vertical lifting of the cursor 130' so as to come into contact with downwardly projecting gear teeth inside the shaft 110', whereby its rotation is effected in accordance with the indexation principles described earlier in this specification.

To recap, however, during the heating cycle, the piston of the wax motor 150' extends so as to raise the cursor element 130', and disengage lower gear teeth 134' of the cursor 130', from the gear teeth 142' of the cam 140'. As the cursor element 130' rises, the lowermost extent of the cursor 130' becomes completely clear of the cam element 140'. Next, during the heating cycle, sloping surfaces of the upper set of gear teeth 132' of the cursor 130', come into contact with sloping surfaces at the end of gear teeth provided by the formations 112' internally of the shaft 110'.

Figure 12A:
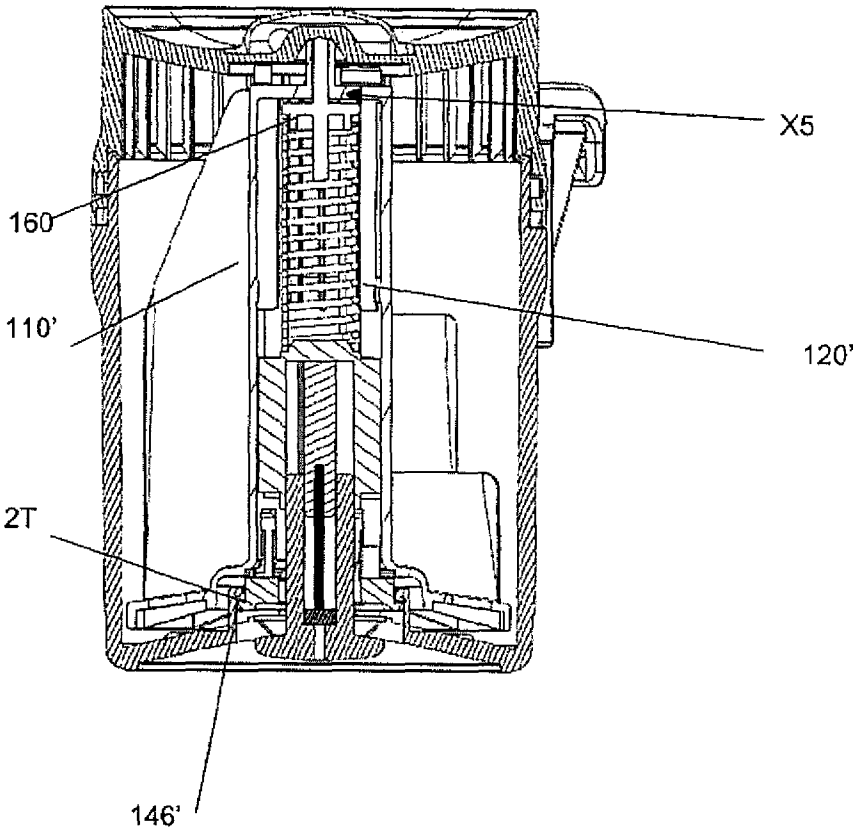
FIG. 12(A), is a cross-sectional side view of the assembled detergent dispensing device in a state in which the wax motor of the device is at a fully expanded stroke state.
Figure 12B:
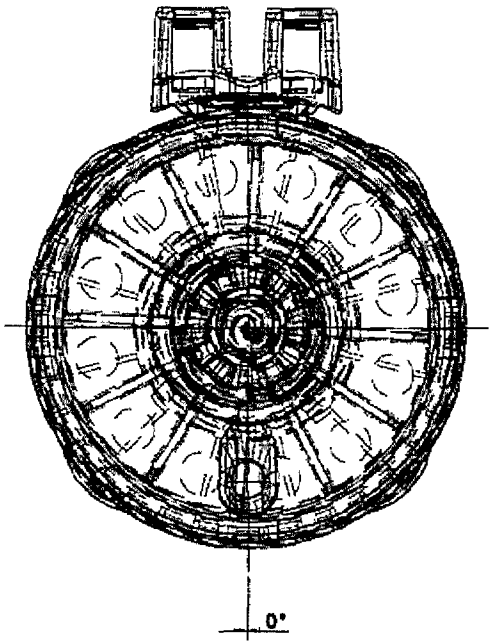
FIG. 12(B) shows the device of FIG. 13(A) from a top view.

FIGS. 12(A), (B), show the device in a condition in which the wax motor 150' is fully expanded. There is still a clearance X1 between tangs 146' on the cam 140' and those on the base; and there is still a clearance X5 between the ridge 169 of the clutch 160 and the inside of the top wall 110W of the shaft 110'. As shown in FIG. 12(B), the state in which rotation of the shaft 110' stops during heating, is the 0° state, i.e. the point at which the refill chamber is maximally exposed to the directing means in the lid 3' (fully open in this embodiment).

Figure 13A:
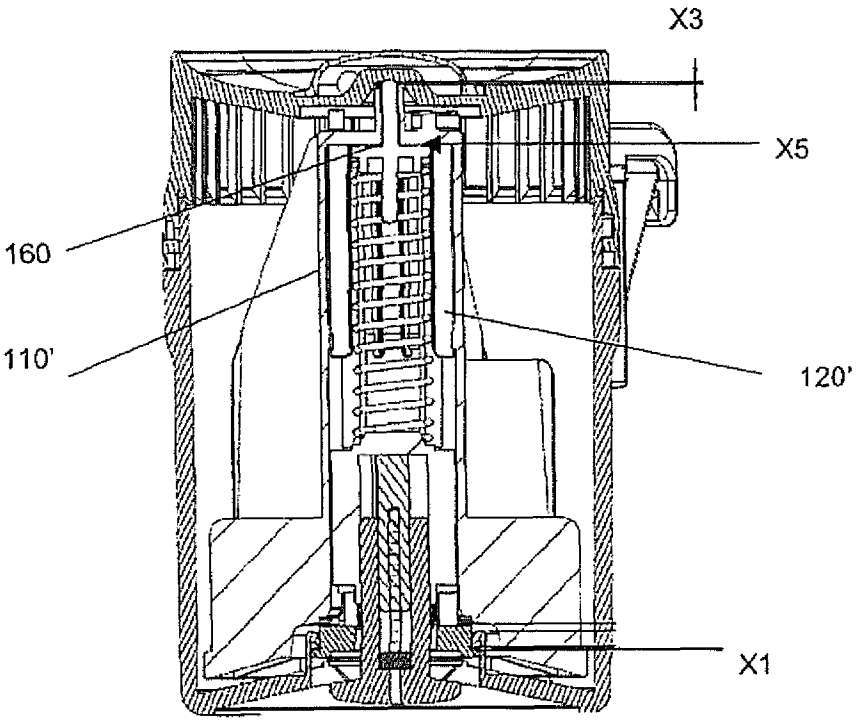
FIG. 13(A), is a cross-sectional side view of the assembled detergent dispensing device in a state in which the device is about to commence rotation during a cooling cycle.
Figure 13B:
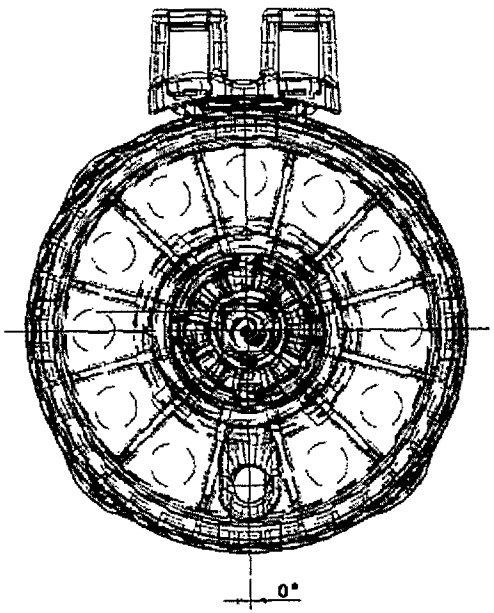
FIG. 13(B) shows the device of FIG. 13(A) from a top view.

FIGS. 13(A), (B) show the device in a cool down phase. Here, cooling of the wax motor 150' under action from compressed spring 120' causes the piston of the wax motor 150' to retract. Now the shaft 110' descends and a clearance X3 once again forms, and there is a clearance X1. The spring 120' urges the clutch element 160 into contact the inner face of the top wall of the shaft 110', and the tip of the clutch element emerges from the sleeve 110P. The ridge 169 of the clutch element once again provides frictional contact with the shaft assembly 110'.

As cooling continues and the piston is urged further into the body of the wax motor 150' under the bias of the ever-acting spring 120' the spring urges the cursor 130' out of engagement with the formations 112' of the shaft 110'. Thereafter, the lower set of teeth 134' of the cursor 130, come into contact with the gear teeth 142' of the cam 140'.

On initial contact of the lower set of teeth 134' and the gear teeth 142' the cursor will impart a downward force to the cam 140', by the force of the spring 120' which causes the shaft/refill holder 110', which of necessity is converted to rotational movement.

Because the clutch element 160 is now resting again against the lower face of the top wall 110W of the shaft 110' it provides a frictional connection between the shaft 110', i.e. to the outer moving parts. It will be understood, therefore, that the torque of the expanding spring 120' does not now oppose rotation, but instead help urge the rotation of the linked set of cam 140' and shaft 110' to cause the extra 24 degree indexation during cooling.

Figure 14A:
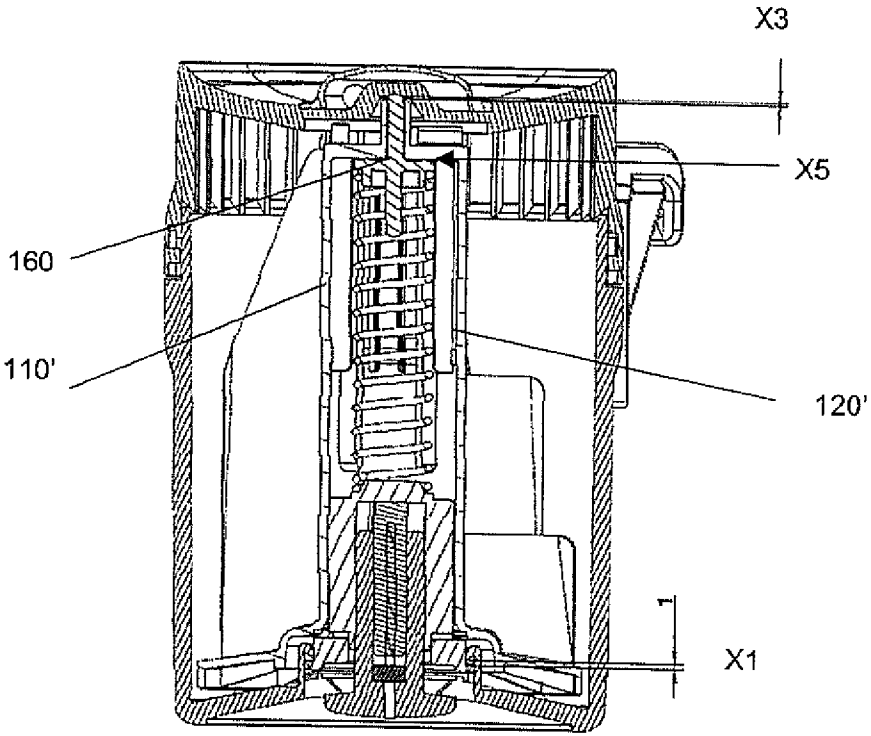
FIG. 14(A), is a cross-sectional side view of the assembled detergent dispensing device in a state in which the wax motor of the device is at the end of a cooling cycle.
Figure 14B:
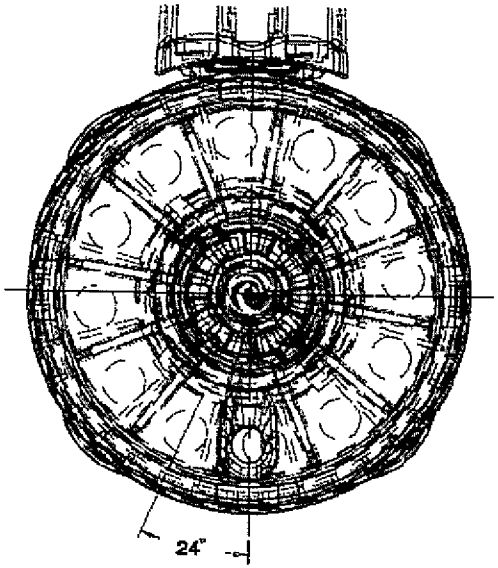
FIG. 14(B) shows the device of FIG. 14(A) from a top view.

Thereby, in the eventual, fully cooled, position shown in FIGS. 14(A), (B) the lower set of gear teeth 134', will be fully meshed with the gear teeth 142' of the cam 140' and the spring 120" will remain in a compressed state to keep the wax motor piston in a retracted state in which it rests against the inside wall of the cursor 130'. Clearance X3 remains at 0.6 mm, while clearance X1 remains at 1 mm because shaft assembly 110' is at its lowest position as given by the retracted piston of the wax motor 150'. During usage the piston will not retract toe the factory supplied zero position.

The skilled man will realise that the above described embodiment sets out a solution to the problem of spring wind up and relieves the potentially significant forces being exerted by wax motor 150' and spring 120' during expansion of the wax motor 150' from being transmitted directly to the shaft 110' by ensuring they are decoupled (clutch disengaged). Further, during a cooling cycle, the clutch element 160 engages so as to couple the spring 120' to the shaft 110' and assist rotation during this cycle.

The skilled person will appreciate that various modifications to the arrangements described may be made without departing from the scope of the invention as defined in the accompanying claims.

The invention claimed is:

1. A multi-dosing detergent delivery device, comprising:

a housing comprising a base and a lid;

a refill holder and shaft located within the housing and arranged, in use, for receiving thereon a cartridge having a plurality X of chambers each accommodating a detergent composition;

a directing means formed in the lid of said device is adapted to direct, in use, wash liquor collected on said lid selectively into a chamber of the cartridge to contact the detergent composition therein;

an outlet formed in a base region of said housing which is adapted to allow, in use, detergent loaded wash liquor to exit the device; and indexing means located within the shaft of the device adapted for causing, in use, automatic movement of said cartridge relative to said housing during and subsequent to a wash cycle so as to cause a neighbouring chamber to be in an exposed, ready to be used, position prior to a next washing cycle, said indexing means comprising: a thermally reactive element, a resilient biasing means, a gearing mechanism and a clutch element adapted for selectively decoupling forces generated by expansion of said thermally reactive element from said shaft.

2. The device according to claim 1, wherein said clutch element comprises a plate area and a central projection.

3. The device according to claim 2, wherein said thermally reactive element comprises a wax motor which sits within a holder that is located within a base area of said housing.

4. The device according to claim 3, wherein said gearing mechanism comprises first and second rotational elements adapted to be moved in a first rotational direction and a linear element adapted for linear movement, and wherein said thermally reactive element is constructed, in use, is adapted to expand and move said linear element in a first linear direction in line with said shaft during a heating phase of a washing cycle and then, during and subsequent to a final cooling phase, and to contract under pressure of said resilient biasing means and to urge said linear element in a second linear direction, opposite to said first linear direction.

5. The device according to claim 4, wherein said clutch element is located between an upper end of said resilient biasing means and an upper end region of said shaft and said central projection protrudes through a reduced diameter sleeved portion of said shaft.

6. The device according to claim 5, wherein one side of said plate area is adapted to operate as a seat for an upper end of said resilient biasing means and the other side of said plate area opposes an inner upper end of said shaft, and wherein said central projection has a tip portion which, in use, projects through said sleeved portion to selectively contact with the lid of the device.

7. The device according to claim 6, wherein said clutch element further comprises a skirt adapted to locate said resilient biasing means upon said one side of said plate area.

8. The device according to claim 7, wherein said other side of said plate area comprises a raised ridge forming a low friction contact area between said clutch element and said inner upper end of said shaft.

9. The device according to claim 8, wherein in a cold state of said thermally reactive element, a first gear portion of said linear element is fully meshed with a gear portion of said first rotational element and, in a hot state of said thermally reactive element, a second gear portion of said linear element is fully meshed with a gear portion of said second rotational element.

10. The device according to claim 9, wherein said second rotational element comprises said shaft and said first rotational element is connected to said shaft such that each impart rotational movement to said shaft under action of the linear element.

11. The device according to claim 10, wherein, in use, in a cold state of said device, said tip portion is disengaged from the lid.

12. The device according to claim 11, wherein, in use, expansion of said thermally reactive element during a first part of said heating cycle is adapted to cause said tip portion to engage against said lid.

13. The device according to claim 12, wherein, in use, further expansion of said thermally reactive element during subsequent parts of said heating cycle is adapted to cause pressures exerted by said thermally reactive element and said resilient biasing means to be transmitted to the lid and base of the device by direct pressure from the tip of the clutch element upon said lid and against the base.

14. The device according to claim 13, wherein during said heating cycle said thermally reactive element is adapted to move in a first linear direction and impart linear motion to the shaft to decouple torque forces between the spring and the shaft.

15. The device according to claim 14, wherein, in use, as said linear element is adapted to further engage with said second rotational element further motion of said linear element in said first linear direction imparts a rotational movement in a first rotational direction to said second rotational element.

16. The device according to claim 15, wherein, in use, a cooling cycle of said device is adapted to cause said thermally reactive element to move in a second linear direction opposite to said first linear direction to descent relative to shaft and engage the clutch element to the shaft.

17. The device according to claim 16, wherein, in use, said linear element is adapted to disengage from said second rotational element and to engage with said first rotational element.

18. The device according to claim 17, wherein following initial engagement of said linear element with said first rotational element further motion in said second linear direction is adapted to impart a rotational movement in the first rotational direction to said first rotational element.

19. A method of indexing a multi-dosing detergent delivery device, the method comprising the step of:

providing a device which comprises:

a housing comprising a base and a lid;

a refill holder and shaft located within the housing and which is adapted for receiving thereon a cartridge having a plurality X of chambers each accommodating a detergent composition;

a directing means formed in the lid of said device which is adapted to direct wash liquor collected on said lid selectively into a chamber of the cartridge and to contact the detergent composition therein;

an outlet adapted to allow the detergent loaded wash liquor to exit the device; and indexing means which is adapted for automatic movement of said cartridge relative to said housing during and subsequent to a wash cycle so as to cause a neighbouring chamber to be in an exposed, ready to be used, position prior to a next washing cycle, said indexing means being located within the shaft of the device and comprising: a thermally reactive element, a resilient biasing means, a gearing mechanism and a clutch element, wherein said method of indexing comprises the steps of:

(A) expansion of said thermally reactive during a heating phase of a washing cycle; and (B) contraction of said thermally reactive element under pressure of said resilient biasing means as it cools during and subsequent to a cooling phase of said washing cycle, said gearing mechanism being arranged, in use, to convert linear expansion and contraction of said thermally reactive element to rotational movement of said refill holder and shaft relative to said housing and wherein said clutch element is provided between said resilient biasing means and said shaft so as to decouple said resilient biasing means from said shaft during at least part of said heating cycle.

20. The method according to claim 19, wherein the clutch element comprises: a plate area and a central projection, wherein one side of said plate area is formed for seating against resilient biasing means of said device and the other side of said plate area is arranged for selective engagement against an inner upper end of a shaft of the device.

21. The method according to of claim 20, wherein said clutch element is located, in use, between said inner upper end of said resilient biasing means and an upper end region of said shaft and said central projection protrudes through a reduced diameter sleeved portion of said shaft.

22. The method according to claim 21, wherein said central projection has a tip portion which, in use, projects through said sleeved portion to selectively contact with the lid of the device.

23. The method according to claim 22, wherein said clutch element further comprises a skirt for locating said resilient biasing means upon said one side of said plate area.

24. The method according to claim 23, wherein said other side of said plate area comprises a raised ridge forming a designated high friction contact area between said clutch element and said inner upper end of said shaft.

25. The method according to claim 24, wherein said gearing mechanism comprises first and second rotational elements capable of movement in a first rotational direction and a linear element which is capable of linear movement, and wherein said thermally reactive element is constructed, in use, so as to expand and move said linear element in a first linear direction in line with said shaft during a heating phase of a washing cycle and then, during and subsequent to a final cooling phase, to contract under pressure of said resilient biasing means and urge said linear element in a second linear direction, opposite to said first linear direction.

26. The method according to claim 25, wherein the central projection of said clutch element protrudes through said shaft and as said thermally reactive element expands during a sub-step (A)(i) of step (A) wherein said central projection of said clutch element moves into abutment against the lid of the device.

27. The method according to claim 26 wherein during a sub-step (A)(ii) of said step (A), wherein a second stage of expansion of said thermally reactive device causes said shaft to raise and decouple an inner upper end of said shaft from the resilient biasing means.

28. The method according to claim 27, wherein during said substeps steps (A)(i) and (A)(ii), said linear element moves in said first linear direction until it comes into contact with, and then raises, said second rotational element.

29. The method according to claim 28, wherein during a sub-step (A)(iii) of said step (A), said linear element is engaged with said second rotational element to convert further linear expansion of said thermally reactive element to rotational movement of said refill holder and shaft relative to said housing.

30. The method according to claim 19, wherein said thermally reactive element contracts during a sub-step (B)(i) of step (B) wherein said linear element of said gearing mechanism moves in said second linear direction to come into contact with said first rotational element and to cause said shaft to descend such that the inner upper end of said shaft comes into contact with said other side of said plate area.

31. The method according to claim 30, wherein during a sub-step (B)(i) of step (B) further movement of said linear element of said gearing mechanism moves in said second linear direction causes said first rotational element to cause said shaft to rotate in said first rotational direction.

* * * * *